United States Patent [19]

Sato

[11] 3,959,840

[45] June 1, 1976

[54] PIPE CLEANING APPARATUS

[76] Inventor: Tadayoshi Sato, No. 117, Mizumoto Koai Kamimachi, Katsushika, Tokyo, Japan

[22] Filed: Feb. 12, 1975

[21] Appl. No.: 549,378

[30] Foreign Application Priority Data

Feb. 13, 1974 Japan ..... 49-17358[U]

[52] U.S. Cl. ..... 15/104.3 SN; 134/167 C

[51] Int. Cl.[2] ..... B08B 9/02

[58] Field of Search ..... 15/104.3 R, 104.3 SN; 134/167 C

[56] References Cited

UNITED STATES PATENTS

| | | | |
|---|---|---|---|
| 2,244,735 | 6/1941 | Silverman | 15/104.3 SN |
| 2,608,421 | 8/1952 | Schnepp | 15/104.3 SN X |
| 2,758,917 | 8/1956 | Popp | 15/104.3 SN X |
| 3,370,599 | 2/1968 | Ciaccio | 15/104.3 SN X |

*Primary Examiner*—Edward L. Roberts

[57] ABSTRACT

In a pipe cleaning apparatus with a rotatable lapped coil spring for insertion into a pipe to be cleaned, a flexible tube is accommodated in the coil spring throughout a length thereof which at its one end is connected to an injection nozzle in communication with an end of the flexible tube which at its opposite end is connected to a high pressure water supply source.

3 Claims, 4 Drawing Figures

PIPE CLEANING APPARATUS

BACKGROUND OF THE INVENTION

This invention relates to a pipe cleaning apparatus for drain pipes and the like.

On the inner circumferential wall of water transmission pipes such as drain pipes and the like, "scale" is precipitated and is gradually accumulated to disturb a smooth flow of the fluid due to increased resistance in the pipe on account of the accumulated scale.

To scrape off the scale, it has been conventional to insert a rotatable coil spring into the pipe for cleaning. However, such spring when inserted into a curved pipe for example as shown in FIG. 2 can not scrape off the scale sufficiently. Similarly, the pipe cleaning apparatus of the type which cleans the pipe by simply injecting a stream of high pressure water into the pipe is not effective.

To improve the conventional pipe cleaning apparatus, there is provided according to the present invention pipe cleaning apparatus which comprises a rotatable lapped coil spring and a flexible tube accommodated in the spring throughout a length thereof wherein the spring at its one end is connected to an injection nozzle in communication with an end of the flexible tube which at it opposite end is connected to a high pressure water supply source. The pipe cleaning apparatus in accordance with the invention is effective to clean even curved tubes.

SUMMARY OF THE INVENTION

A general object of the invention is to provide a pipe cleaning apparatus which is able to clean straight as well as curved tubes.

A principal object of the invention is to provide a pipe cleaning apparatus which includes a coil spring and a flexible tube there wherein the spring at its one end is operatively connected to an injection nozzle in communication with an end of the flexible tube which at its opposite end is connected to a high pressure water supply source.

Other objects and advantages of the invention will become apparent as the detailed description thereof proceeds.

For a fuller understanding of the present invention reference should now be had to the following detailed description thereof taken in conjunction with the accompanying drawings, wherein:

DESCRIPTION OF PREFERRED EMBODIMENT OF THE INVENTION

Figure 1:
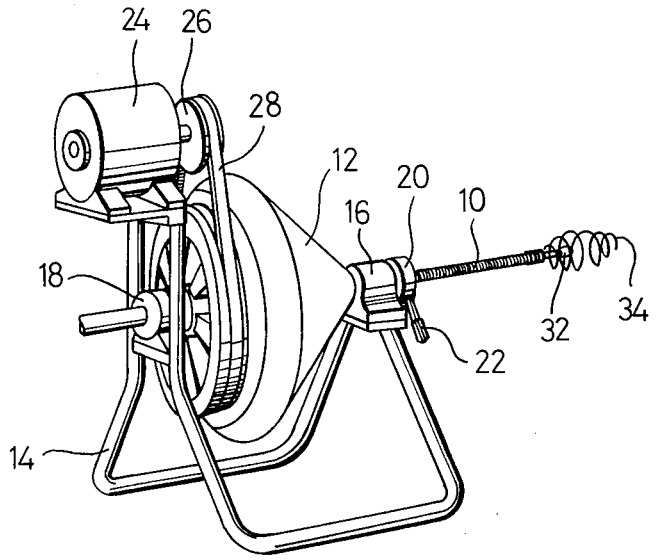
FIG. 1 is a perspective view of the pipe cleaning apparatus in accordance with the present invention.
Figure 2:
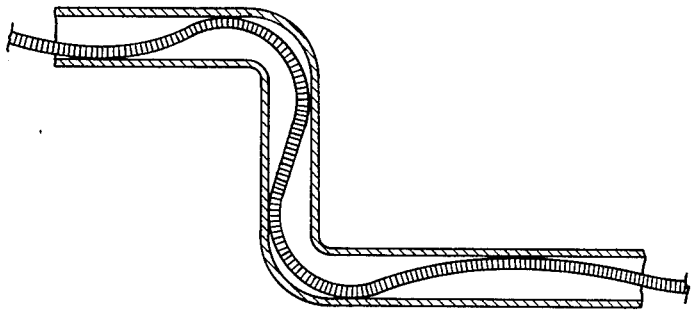
FIG. 2 is a longitudinally sectioned view of a curved pipe with a cleaning coil therein.
Figure 3:
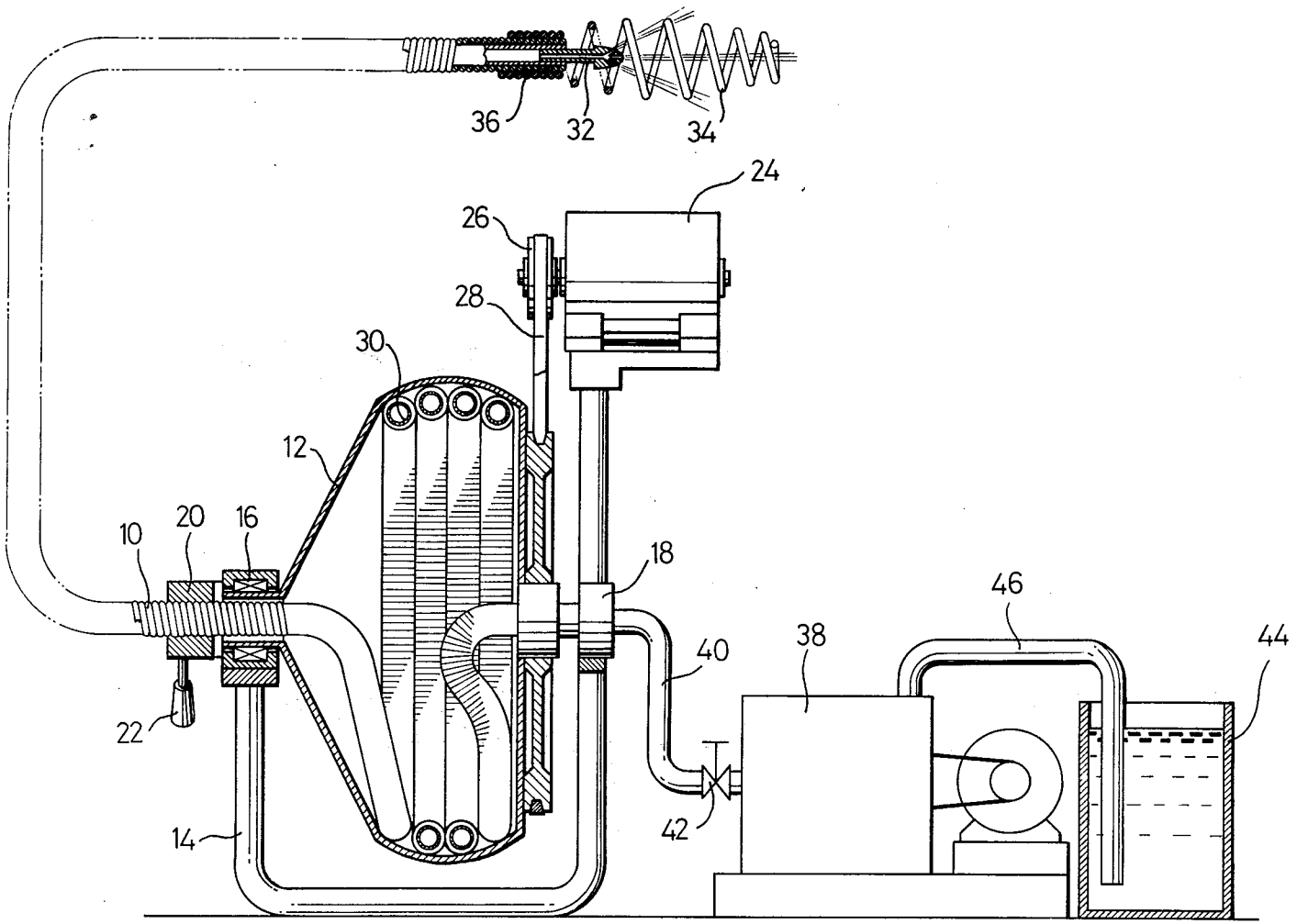
FIG. 3 is an enlarged horizontal view partially, in cross-section, of the pipe cleaning apparatus shown in FIG. 1.

In FIGS. 1 and 3, the pipe cleaning apparatus in accordance with the invention comprises a lapped coil spring 10 preferably made of an anticorrosive metal such as stainless steel, a casing 12 for accommodating therein a wound spring 10 and a frame 14 for rotatably supporting the casing 12 by means of bearings 16 and

18. In abutment with the bearing 16 is mounted a chucking ring 20 with a handle lever 22 for opening and closing the chuck.

The chucking ring 20 at its internal periphery is provided with a spiral notch capable of receiving the coil spring 10 so that the coil spring 10 when turned in accordance with rotation of the casing 12 may advance one pitch of the coil spring 10 for each revolution of the casing. The casing 12 is turned by a driving motor 24 through a pulley 26 and a belt 28.

Figure 4:
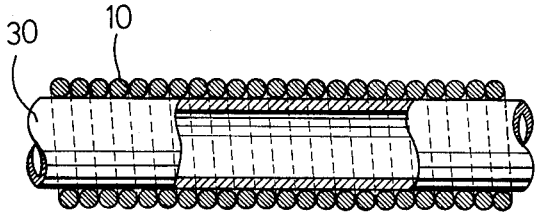
FIG. 4 is a longitudinally sectioned view of the cleaning coil with and flexible tube therein.

In FIGS. 3 and 4, a flexible tube 30 is mounted concentrically within coil spring 10 so as to terminate at the end of the spring 10 in communication with an injection nozzle 32. To the end of the spring 10 is attached through a fitting member 36 a pilot member or auger 34 for faciitating the cleaning effect of the coil spring 10 while protecting the injection nozzle 32 from any damage. The flexible tube 30 at its opposite end is connected to a high pressure water injection pump 38 through a line 40 have a valve 42 therein. The pump 38 communicates with a water tank 44 through a conduit 46.

In the operation of the pipe cleaning apparatus in accordance with the present invention, the end of spring 10 with the injection nozzle 32 and the auger 34 is inserted into the pipe for cleaning water is discharged through the nozzle 32 so that the scale on the inner wall of the pipe is scraped off by the auger 34 conjointly with a high pressure water spray. The residual scale is also removed by the spring 10.

The flexible tube is sufficiently protected by the encircling spring coil which is also always kept in place by means of the flexible tube even if it should break during the cleaning operation.

While a certain preferred embodiment of the invention has been illustrated by way of example in the drawings and particularly described, it will be understood that various modifications may be made in the construction and that the invention is no way limited to the embodiments shown.

What I claim is:

1. A pipe cleaning apparatus comprising in combination: a rotatable and extensible cleaning member including a coil spring having the convolutions thereof in closely engaging relation and a flexible tube positioned concentrically therein; a source of high pressure water connected to one end of said flexible tube and a discharge nozzle mounted in and extending from the other end of said flexible tube; an auger having an outer diameter greater than that of said cleaning member connected to and extending from the end of said spring in surrounding relation to said nozzle; said nozzle having at least two diverging discharge outlets whereby a divergent stream of said high pressure water is discharged directed towards the peripheral portion of said auger; and means for rotating and advancing said cleaning member into the pipe to be cleaned.

2. A pipe cleaning apparatus according to claim 1, wherein said auger comprises a coiled element having convolutions of decreasing diameter at the free end thereof.

3. A pipe cleaning apparatus according to claim 1, wherein said means for rotating and advancing said cleaning member includes a rotatable casing having a spiral opening adapted to store a section of said coil spring and to discharge same at the rate of one pitch length of coil spring for each revolution of said casing.

* * * * *